United States Patent [19]

Feingold et al.

[11] 4,108,307

[45] * Aug. 22, 1978

[54] STORAGE BINDER

[76] Inventors: Irene B. Feingold; Stanley Z. Feingold, both of 420 Pitts Colony Dr., Rochester, N.Y. 14623

[ * ] Notice: The portion of the term of this patent subsequent to Aug. 16, 1991, has been disclaimed.

[21] Appl. No.: 685,176

[22] Filed: May 11, 1976

[51] Int. Cl.[2] ..... B65D 85/672

[52] U.S. Cl. ..... 206/387

[58] Field of Search ..... 206/387, 216, 309

[56] References Cited

U.S. PATENT DOCUMENTS

| | | | |
|---|---|---|---|
| D. 226,146 | 1/1973 | Price | 206/387 |
| D. 245,454 | 8/1977 | Feingold et al. | D87/1 D |
| 3,641,684 | 2/1972 | Paige | 206/387 |
| 3,642,125 | 2/1972 | Johnson | 206/387 |
| 3,823,814 | 7/1974 | Lum | 206/225 |
| 3,829,132 | 8/1974 | Willieme | 206/387 |
| 3,865,237 | 2/1975 | Isaacs | 206/387 |
| 4,002,355 | 1/1977 | Sendor | 206/387 |
| 4,004,689 | 1/1977 | Glasell | 206/387 |
| 4,009,781 | 3/1977 | Agnew et al. | 206/387 |

*Primary Examiner*—Herbert F. Ross

*Attorney, Agent, or Firm*—Harold Huberfeld

[57] ABSTRACT

A storage binder for audiovisual material comprises a first and second cover member each having an inner and outer surface. A spine member joins the first and second cover members. A first mounting bracket is affixed to the inner surface of the first cover member for securing a slide tray thereto. A second mounting bracket is affixed to the inner surface of the second cover member for securing an audio cassette thereto.

2 Claims, 3 Drawing Figures

STORAGE BINDER

BACKGROUND OF THE INVENTION

A. Field of the Invention

The present invention relates generally to storage binder construction and in particular to a storage binder for holding audio cassette tapes, photographic slide trays, and other material requiring a storage pocket.

B. Description of the Prior Art

When making audiovisual presentations in the area of education, sales, and the like, one generally needs to transport 35 mm photographic slides, audio cassette tapes, and written note material. In the past this material has been somewhat clumsy to transport and store. Various partial solutions to this problem have been proposed in the prior art. Audio cassettes have been stored in carrying containers as shown in U.S. Pat. No. D. 226,146. Additionally audio cassettes have been stored with note material in a carrying container as shown in U.S. Pat. Nos. 3,829,132; 3,866,751; and 3,896,929. Finally, in U.S. Pat. No. 3,823,814 an apparatus is proposed for attaching an audio cassette and a film strip to a hard carrying cover. However, none of the above prior art solutions are concerned with storing a photographic slide tray with either an audio cassette or written note material.

Thus, a critical problem remains that no secure and convenient storage has been provided for audiovisual presentations which require photographic slides, an audio cassette tape, and note material.

OBJECTS OF THE INVENTION

An object of the present invention is the provision of a storage binder which is capable of containing audio cassettes, a photographic slide tray, and note material.

Another object of the present invention is to provide a storage binder which is securely locked and protects the contents from spills, dust, and damage.

A further object of the present invention is the provision of a storage binder which is inexpensive to manufacture.

Still another object of the present invention is to provide a storage binder which is simple in construction.

Yet another object of the present invention is to provide a storage binder for audiovisual material which is convenient to store.

SUMMARY OF THE INVENTION

Thus, a storage binder for audiovisual material is provided which comprises a first and second cover member each having an inner and outer surface. A spine member joins the first and second cover members. A first mounting bracket is affixed to the inner surface of the first cover member for securing a slide tray thereto. A second mounting bracket is affixed to the inner surface of the second cover member for securing an audio cassette thereto.

For a better understanding of the present invention, together with other and further objects thereof, reference is had to the following description, taken in connection with the accompanying drawings, while its scope will be pointed out in the appended claims.

DESCRIPTION OF THE PREFERRED EMBODIMENT

Figure 1:
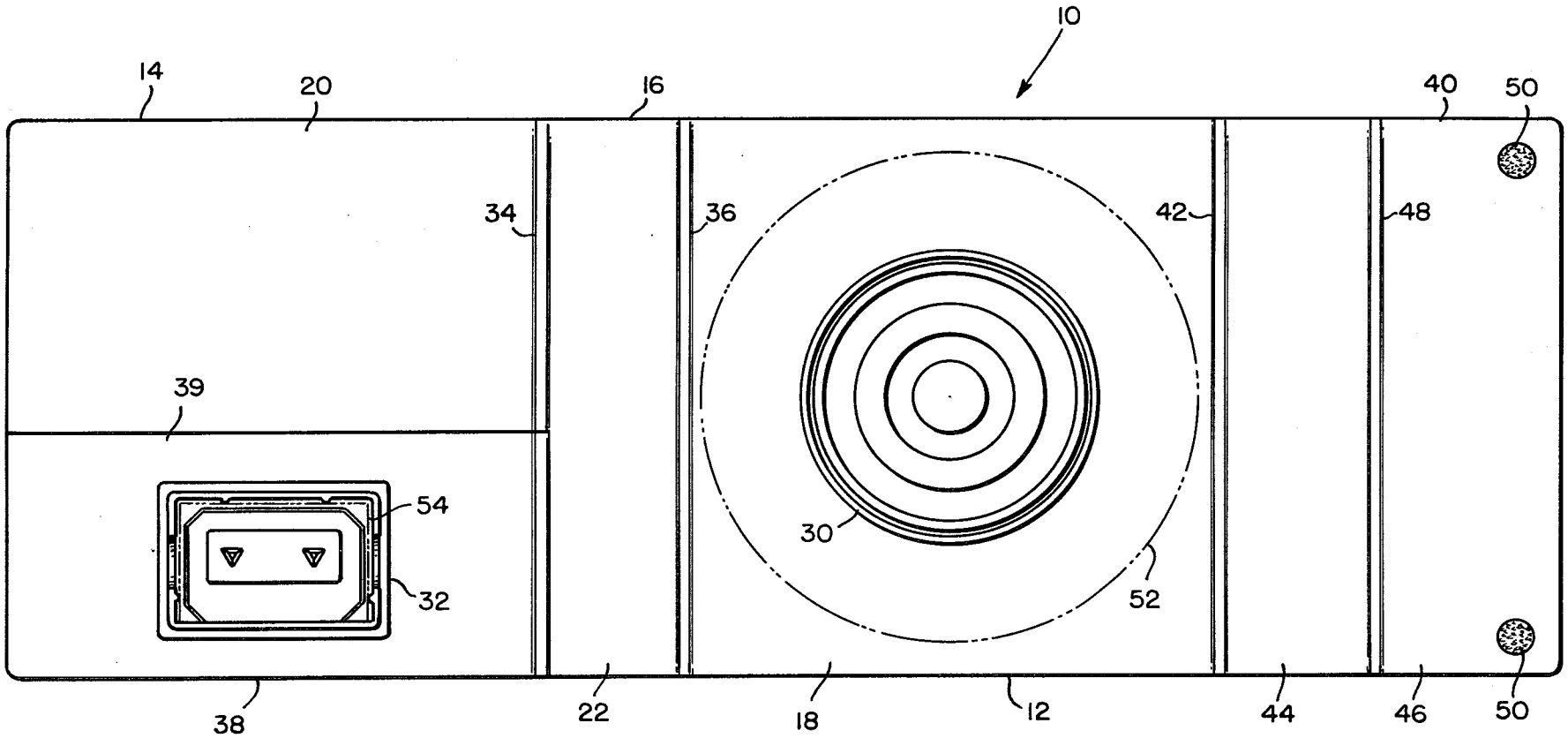
FIG. 1 is a front view of a storage binder according to the present invention.
Figure 2:
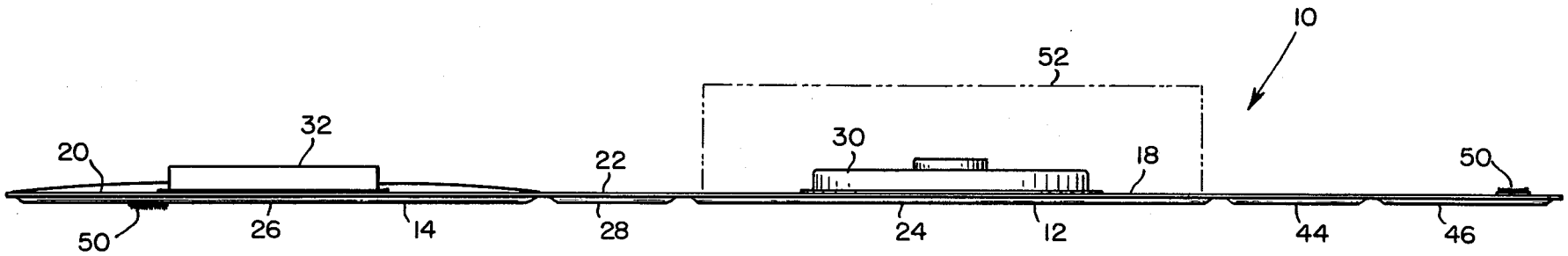
FIG. 2 is a side view of the storage binder according to the present invention.
Figure 3:
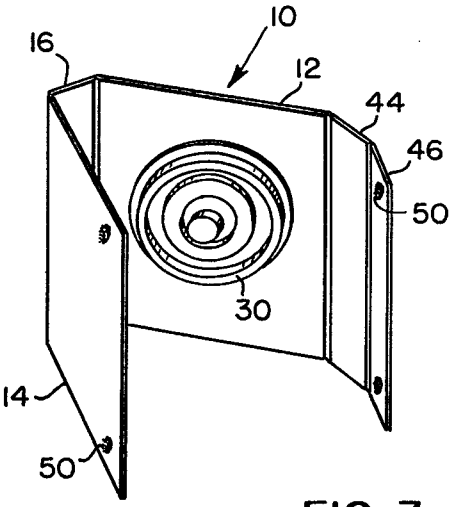
FIG. 3 is a perspective view of a storage binder according to the present invention.

In the exemplary embodiment of the invention as disclosed in FIG. 1, a storage binder 10 for audiovisual materials includes a first cover member 12 and a second cover member 14 joined together by a spine member 16. Each of the cover members and the spine member are preferably planar in shape and have inner surfaces 18, 20, and 22 as well as outer surfaces 24, 26, and 28. Cover member 12 has a mounting bracket 30 affixed thereto for securing a photographic slide tray 52 on the inner surface 18 of the cover member 12. Mounting bracket 30 is permanently affixed to inner surface 18 by any suitable means such as, for example, bonding. Cover member 14 has affixed thereto a mounting bracket 32 for securing an audio cassette 54 on the inner surface 20. The cover member 14 also has a storage pocket 34 on the inner surface 20 of the cover member 14.

The cover members 12, 14, and the spine member 16 are joined together along the hinged edges 34 and 36 so that the cover members 12 and 14 may be folded to a position where their inner surfaces 18 and 20 are facing each other. The cover members 12 and 14 as well as spine member 16 may be constructed of any rigid material such as, for example, leather or plastic covered panels of cardboard, wood, or metal.

The construction of mounting bracket 30 is such that it is precisely designed to accept and tightly lock into position by snap fit most standard types of rotating slide trays. Although a rotating slide tray 52 is illustrated in the drawings, it is within the scope of the present invention to use any other type of photographic slide tray. Once the slide tray is inserted onto the bracket, the slides are secure from spills, dust, and damage. Mounting bracket 30 may be made of any desirable material such as, for example, plastic.

The second cover member 14 includes a storage pocket 39 on the inner surface 20 of the cover member 14. This storage pocket may be made of any suitable material such as, for example, plastic, and may extend from the bottom edge 38 of cover member 14 and extend to cover any desirable portion of inner surface 20 such as, for example, one-half of the surface area. This storage pocket 39 provides a handy place to store notes, scripts, and any other printed material or other type material which is desirable to carry in the storage binder 10. The storage pocket 39 may be made of any desirable material such as, for example, the material of which the rest of the storage binder 10 is constructed.

A mounting bracket 32 is affixed to the storage pocket 39 for securing an audio cassette. Mounting bracket 32 is permanently affixed to the storage pocket 39 by any suitable means such as, for example, bonding. The mounting bracket 32 is constructed to secure any type of desired audio cassette preferably by snap fit. The mounting bracket 32 may be made of any desirable material such as, for example, plastic.

Cover members 12 and 14 have a releasable securing structure for selectively holding cover members 12 and 14 in a folded position where inner surfaces 18 and 20 are facing each other. Releasable securing means 40 are fixedly joined to cover member 12 along hinged edge 42. Securing means 40 includes third and fourth cover members 44 and 46. The third and fourth cover members are also preferably planar in shape and are joined to each other along hinged edge 48. When the storage binder 10 is closed so that its inner surfaces 18 and 20 face each other, the releasable securing structure 40 folds on hinged edge 42 so that cover member 44 is parallel to spine member 16. Then cover member 46 folds down onto the outer surface 26 of cover member 14 and secures storage binder 10 in a closed position. Cover member 46 may be adhered to cover member 14 by any securing device such as, for example, friction fasteners 50.

Thus, a storage binder has been illustrated which provides convenient storage for audiovisual presentations requiring photographic slides, audio cassettes, and note material. Further, the storage binder may be of a size which conveniently fits into a bookcase and thereby provides easy storage for a number of the illustrated binders. Also once the material is secured in the binder, it is less subject to damage from spills or dust. Finally, the illustrated storage binder is simple in construction and inexpensive to manufacture.

Although the invention has been described and illustrated in detail, it is to be clearly understood that the same is by way of illustration and example only and is not to be taken by way of limitation, the sphere and scope of this invention being limited only by the terms of the appended claims.

What is claimed is:

1. A storage binder for audiovisual material comprising:

(a) a first generally rectangular cover member having an inner and an outer surface, (b) first mounting bracket means affixed to the inner surface of said first cover member and centered thereon for securing a circular photographic slide tray thereto by friction engagement therewith, (c) a second generally rectangular cover member having an inner and an outer surface including a storage pocket on the inner surface thereof, said storage pocket extending from the bottom of said second cover member upward and extending across the entire width of the inner surface of said second cover member to thereby cover a substantial portion of the inner surface of said second cover member, (d) second mounting bracket means affixed to said storage pocket for securing an audio cassette thereto by friction engagement therewith, and (e) a spine member joining said first and second cover members in a hinged relationship.

2. A storage binder as defined in claim 1, further comprising:

(a) third and fourth generally rectangular cover members, each having an inner and an outer surface, said third cover member being joined to one of said first cover and said second cover member in a hinged relationship, and said fourth cover member being joined to said third cover member in a hinged relationship, and (b) releasable securing means for selectively holding said cover members in a folded position, said securing means being affixed to the outer surface of said first cover means and the inner surface of said fourth cover means to selectively join said first and fourth cover means.

* * * * *